US010267205B2

(12) United States Patent
Matsumoto et al.

(10) Patent No.: US 10,267,205 B2
(45) Date of Patent: Apr. 23, 2019

(54) EXHAUST SYSTEM FOR ENGINE

(71) Applicant: KAWASAKI JUKOGYO KABUSHIKI KAISHA, Kobe-shi, Hyogo (JP)

(72) Inventors: Takafumi Matsumoto, Himeji (JP); Kenichi Ohkita, Kakogawa (JP)

(73) Assignee: KAWASAKI JUKOGYO KABUSHIKI KAISHA (JP)

( * ) Notice: Subject to any disclaimer, the term of this patent is extended or adjusted under 35 U.S.C. 154(b) by 473 days.

(21) Appl. No.: 15/071,519

(22) Filed: Mar. 16, 2016

(65) Prior Publication Data

US 2017/0138246 A1 May 18, 2017

Related U.S. Application Data

(63) Continuation of application No. PCT/JP2014/070825, filed on Aug. 7, 2014.

(30) Foreign Application Priority Data

Oct. 21, 2013 (JP) ..... 2013-218504

(51) Int. Cl.
*F01N 3/28* (2006.01)
*F01N 13/00* (2010.01)
(Continued)

(52) U.S. Cl.
CPC ..... *F01N 13/007* (2013.01); *F01N 3/2892* (2013.01); *F01N 13/10* (2013.01);
(Continued)

(58) Field of Classification Search
CPC ..... F01N 13/007; F01N 2470/16; F01N 2470/20; F01N 2590/04; G10K 11/161
(Continued)

(56) References Cited

U.S. PATENT DOCUMENTS 5,248,859 A * 9/1993 Borla ..... F01N 1/04 181/238
6,220,387 B1 * 4/2001 Hoppes ..... F01N 1/14 181/227
(Continued)

FOREIGN PATENT DOCUMENTS

CN 103032144 4/2013
EP 1515019 3/2005
(Continued)

OTHER PUBLICATIONS

First Office Action dated Sep. 14, 2017, for Corresponding Chinese Patent Application No. 201480055961.0 with English language translation of the Search Report attached to the Office Action (7 pages).
(Continued)

*Primary Examiner* — Forrest M Phillips

(57) ABSTRACT

An exhaust system for the engine includes two exhaust pipes for discharging therethrough exhaust gases from the engine, a muffler for silencing the exhaust gases, an introducing pipe for introducing the exhaust gases into the muffler and a collecting duct for merging the exhaust gases from the two exhaust pipes together and then to introduce them into the introducing pipe. The collecting duct has a single outlet opening within an interior of the introducing pipe, which single outlet opening has a first passage area that is chosen to be smaller than the sum of respective second passage areas of discharge openings of the exhaust pipes and also to be smaller than a third passage area of the introducing pipe.

7 Claims, 6 Drawing Sheets

(51) Int. Cl.

| | |
|---|---|
| ***F01N 13/10*** | (2010.01) |
| ***F01N 13/18*** | (2010.01) |
| ***G10K 11/16*** | (2006.01) |

(52) U.S. Cl.
CPC ..... *F01N 13/18* (2013.01); *G10K 11/161* (2013.01); *F01N 2470/16* (2013.01); *F01N 2470/20* (2013.01); *F01N 2590/04* (2013.01)

(58) Field of Classification Search
USPC ..... 181/240, 228
See application file for complete search history.

(56) References Cited

U.S. PATENT DOCUMENTS

| | | | | |
|---|---|---|---|---|
| 7,458,210 | B2 | 12/2008 | Kikuchi et al. | |
| 7,895,832 | B2 * | 3/2011 | Gruber | F01N 1/02 181/227 |
| 8,006,488 | B2 | 8/2011 | Momosaki et al. | |
| 9,228,476 | B2 | 1/2016 | Yamaguchi | |
| 2005/0056010 | A1 | 3/2005 | Momosaki et al. | |
| 2007/0137189 | A1 | 6/2007 | Kikuchi et al. | |
| 2013/0074478 | A1 | 3/2013 | Yamaguchi | |

FOREIGN PATENT DOCUMENTS

| | | |
|---|---|---|
| EP | 1748164 | 1/2007 |
| JP | 56-027394 | 6/1981 |
| JP | 63-021318 | 1/1988 |
| JP | 63-208610 | 8/1988 |
| JP | 63-005106 | 11/1988 |
| JP | 02-119922 | 9/1990 |
| JP | 2005-083358 | 3/2005 |
| JP | 2007-032480 | 2/2007 |
| JP | 2007-162653 | 6/2007 |
| JP | 2013-072366 | 4/2013 |

OTHER PUBLICATIONS

Extended and Supplementary Search Report dated Sep. 25, 2017, for Corresponding European Patent Application No. 14855781.2 (7 pages).
Decision of Rejection dated Jul. 4, 2017, for Corresponding Japan Patent Application No. 2013-218504 (1 page).
Decision to Dismiss the Previous Amendment, dated Jul. 4, 2017, for Corresponding Japan Patent Application No. 2013-218504 with English Language Summary (4 pages).
International Search Report, dated Sep. 30, 2014 for PCT/JP2014/070825, filed Aug. 7, 2014 (4 pages).
English Translation of the International Preliminary Report on Patentability and Written Opinion of the International Searching Authority dated May 6, 2016 for International PCT Patent Application No. PCT/JP2014/070825, filed Aug. 7, 2014 (7 pages).
Notification of Reason(s) for Rejection dated May 2, 2017 for Corresponding Japan Patent Application No. 2013-218504 with English Language Summary (4 pages).
Notification of Reason(s) for Rejection dated Feb. 14, 2017 for Corresponding Japan Patent Application No. 2013-218504 with English Language Summary (4 pages).

* cited by examiner

EXHAUST SYSTEM FOR ENGINE

CROSS REFERENCE TO THE RELATED APPLICATION

This application is a continuation application, under 35 U.S.C § 111(a) of international application No. PCT/JP2014/070825, filed Aug. 7, 2014, which claims priority to Japanese patent application No. 2013-218504, filed Oct. 21, 2013, the entire disclosure of which is herein incorporated by reference as a part of this application.

BACKGROUND OF THE INVENTION

Field of the Invention

The present invention relates to an engine exhaust system in which a plurality of exhaust pipes are, after having been merged together, connected with a muffler.

Description of Related Art

In a multi-cylinder engine used in a motorcycle, after a plurality of exhaust pipes have been merged together to provide a collecting duct, the collecting duct is fluid connected with a muffler so that exhaust gases can be silenced by the muffler and be in turn discharged to the outside. In this respect, see, for example, the patent document 1 listed below. In such engine, exhaust interference is controlled by uniformly adjusting lengths measured each from the exhaust port of the engine to the site at which the exhaust pipes are merged together with each other.

PRIOR ART LITERATURE

Patent Document 1: JP Laid-open Patent Publication No. 2007-162653

In such engine, when the engine is accelerated, the engine torque tends to become insufficient during an intermediate-to-low speed rotation range. Accordingly, in the system disclosed in the patent document 1 referred to above, a spherical expansion chamber is provided between the collecting duct and the muffler to alleviate the insufficiency of the torque which would occur during the acceleration at a low speed range. It has, however, been found that the use of the expansion chamber referred to above requires the provision of a space around the engine.

SUMMARY OF THE INVENTION

In view of the foregoing, the present invention has for its important object to provide an engine exhaust system capable of alleviating the insufficiency of the engine torque during an intermediate-to-low speed rotation range, without a space around the engine being oppressed.

In order to accomplish the foregoing object, the exhaust system for the engine according to the present invention includes two exhaust pipes to discharge therethrough exhaust gases from the engine, a muffler to silence the exhaust gases, an introducing pipe to introduce the exhaust gases into the muffler, and a collecting duct to merge the exhaust gases from the two exhaust pipes and then to introduce the exhaust gases into the introducing pipe. The collecting duct has a single outlet opening defined in an interior of the introducing pipe, and the single outlet opening has a first passage area or a cross-sectional area that is chosen to be smaller than the sum of respective second surface areas of discharge openings of the two exhaust pipes and also to be smaller than a third passage area of a portion of the introducing pipe, which portion corresponds to the outlet opening.

According to the present invention as constructed above, by constricting the first passage area at the outlet of the collecting duct, the flow velocity of the exhaust gases is increased. Also, by suppressing the exhaust interference from the two exhaust pipes associated with two cylinders that are different in phase of rotation from each other, the exhaust gases are alternately derived. As a result, the exhaust efficiency can be increased. Also, after the first passage area has been constricted, the third passage area is abruptly increased within the interior of the introducing pipe to induce a pressure drop. Thus, a force of pulling the exhaust gases from the exhaust pipes is rendered to be large, and therefore, the exhaust efficiency can be further effectively increased. Thereby, the insufficiency of the engine torque during the region of the intermediate-to-low speed rotation range can be removed, and also the engine output at the peak time can be increased. In addition, since no component is added, there is no need to consider the space for installation, and the space around the engine will not be oppressed.

In one preferred embodiment of the present invention, the collecting duct referred to above may have a passage area which gradually decreases from a large diameter portion, in which the discharge openings of the two exhaust pipes are inserted, towards a small diameter portion which is inserted into an interior of the introducing pipe, and the large diameter portion is fluid connected with the introducing pipe. According to the construction described above, the exhaust gases from the exhaust pipe flow smoothly within the interior of the collecting duct from the large diameter portion towards the small diameter portion. In addition, since the introducing pipe and the collecting duct are connected with each other at the large diameter portion, it is possible to firmly connect the introducing pipe and the collecting duct together.

In another preferred embodiment of the present invention, a downstream end portion of the exhaust pipe, which forms the discharge opening, may be fluid connected with the collecting duct through an adaptor pipe mounted thereon. According to the construction described above, the collecting duct and the introducing pipe, both forming the merging region, can be commonly used with exhaust pipes having varying outer diameters. Accordingly, the muffler can also be commonly used. In particularly, since the muffler can be commonly used, an effect that the cost can be reduced is markedly appreciated.

In a further preferred embodiment of the present invention, the first the passage area of the outlet opening of the collecting duct may be 0.6 to 0.9 times, preferably 0.70 to 0.85 times, the sum of the second passage areas of the discharge openings of the two exhaust pipes. If the first passage area is smaller than 0.6 times the sum of the second passage areas, the exhaust passage will be strongly constricted enough to increase the pressure resistance. Also, if the first passage area exceeds 0.9 times the sum of the second passage areas, the effect to reduce the exhaust interference will be lowered too much to achieve a sufficient exhaust efficiency.

In a still further preferred embodiment of the present invention, the first passage area of the outlet opening of the collecting duct may be 0.2 to 0.5 times, preferably 0.3 to 0.4 times, the third passage area of the introducing pipe at a position of such outlet opening. If the first passage area is smaller than 0.2 times the third passage area, since the first passage area of the outlet opening of the collecting duct cannot be reduced to a very small value as hereinbefore discussed, the inner diameter of the introducing pipe will become increased and the introducing pipe will therefore increase in size. On the other hand, if the first passage area exceeds 0.5 times the third passage area, the pressure reduction in the introducing pipe will be so small that no sufficient exhaust efficiency can be obtained.

Any combination of at least two constructions, disclosed in the appended claims and/or the specification and/or the accompanying drawings should be construed as included within the scope of the present invention. In particular, any combination of two or more of the appended claims should be equally construed as included within the scope of the present invention.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DESCRIPTION OF PREFERRED EMBODIMENTS

Hereinafter a preferred embodiment of the present invention will be described in detail with particular reference to the accompanying drawings. In describing the present invention, however, the terms "left and right" used hereinabove and hereinafter are to be understood as relative terms description of positions and/or direction as viewed from a driver maneuvering a motorcycle.

Figure 1:
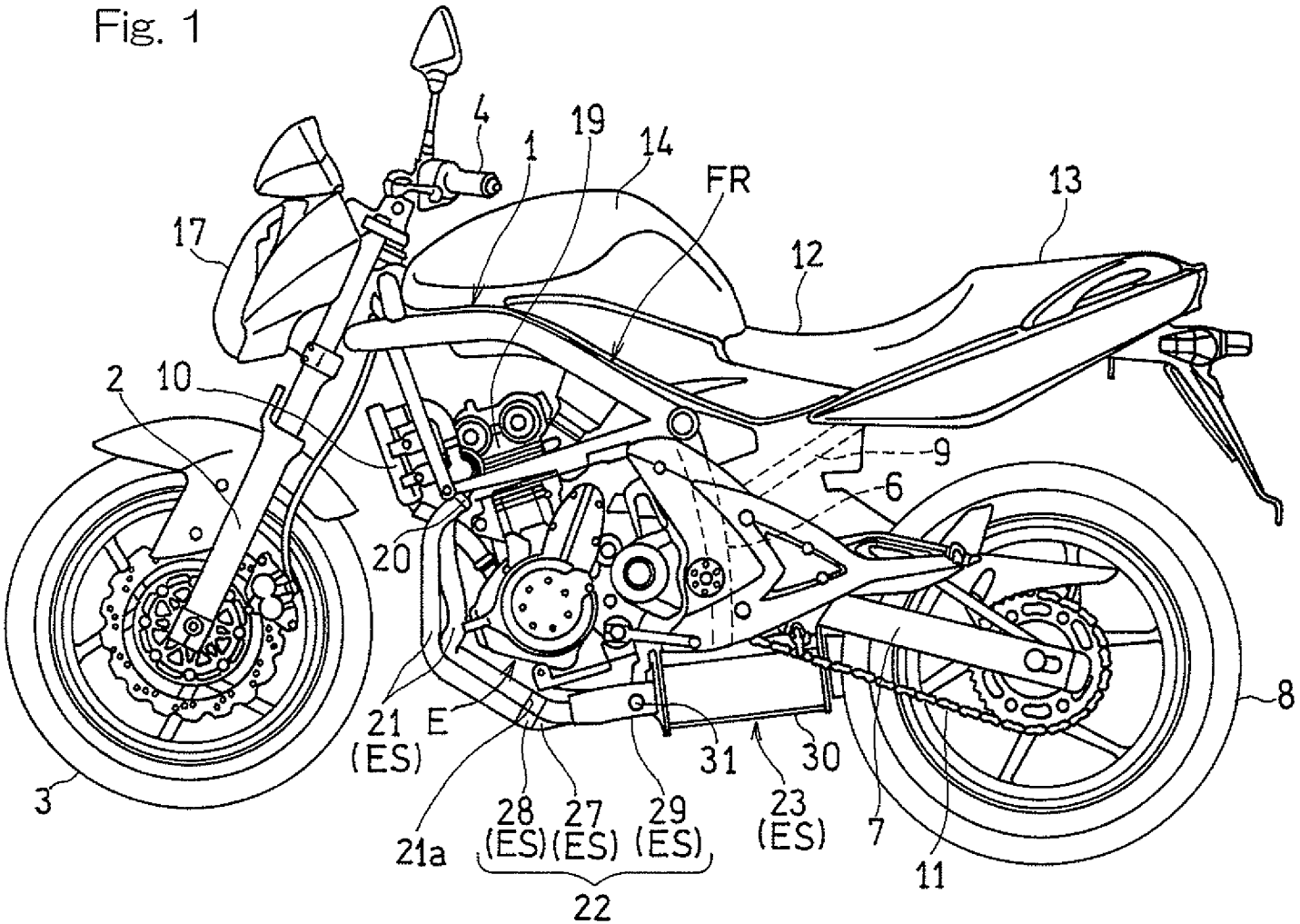
FIG. 1 is a schematic side view showing a motorcycle equipped with an exhaust system for an engine, which system is designed in accordance with a preferred embodiment of the present invention.

FIG. 1 illustrates, as viewed from side, a motorcycle equipped with the exhaust system for the engine that is designed in accordance with a preferred embodiment of the present invention. The motorcycle shown in FIG. 1 includes a main frame 1 forming a part of a front half section of a motorcycle frame structure FR and a front fork 2 supported at a front end of the main frame 1. A front wheel 3 is fitted to a lower end of the front fork 2, and a handlebar 4 is fitted to an upper end of the front fork 2. A swingarm bracket 6 is provided at a rear end lower portion of the main frame 1, and a front end of a swingarm 7 is supported by the swingarm bracket 6 for movement up and down through a pivot pin (not shown). A rear wheel 8 is fitted to a rear end of the swingarm 7.

A seat rail 9 connected with a rear portion of the main frame 1 forms a rear half section of the motorcycle frame structure FR. An engine E is fitted to a lower portion of the main frame 1, and a radiator 10 is disposed forwardly of the engine E. The rear wheel 8 is driven by the engine E through a chain 11, and the front wheel 3 is steered by means of the handlebar 4.

A rider's seat 12 and a fellow passenger's seat 13 are supported in the seat rail 9. A fuel tank 14 is fitted to an upper portion of the main frame 1, that is, at a motorcycle upper portion and between the handlebar 4 and the rider's seat 12. Also, a front headlamp unit 17 is mounted on a motorcycle front portion.

The engine E is in the form of a two cylinder four cycle engine, and two exhaust pipes 21 are fluid connected with respective exhaust ports 20 at a front surface of a cylinder head 19. Those two exhaust pipes 21 are merged together at a merging region 22 below the engine, which region 22 is in turn fluid connected with a muffler 23 disposed between a rear surface of the engine E and the rear wheel 8.

The merging region 22 includes a collecting duct 27, with which each of downstream end portions 21*a* of the two exhaust pipes 21 is fluid connected, and a single introducing pipe 29, with which the collecting duct 27 is fluid connected. A rear end of the introducing pipe 29 is fluid connected with an inlet pipe 26 (best shown in FIG. 4) provided in an interior of the muffler 23. In other words, the introducing pipe 29 is fixed to a muffler casing 30 through the inlet pipe 26. This introducing pipe 29 has an exhaust component detecting sensor 31 fitted thereto for detecting the content of oxygen contained in exhaust gases G so introduced thereinto.

In the practice of this embodiment of the present invention, the two exhaust pipes 21 are fluid connected with the collecting duct 27 through respective adaptor pipes 28 each fluid connected with a downstream end portion 21*a* thereof. Each of the adaptor pipes 28 is used to connect the downstream end portion 21*a* of the associated exhaust pipe 21 with an inlet opening (upstream end) of the collecting duct 27 particularly where the outer diameter of the downstream end portion 21*a* is different from the inner diameter of the inlet opening of the collecting duct 27. The use of the adaptor pipe 28 for each exhaust pipe 21 makes it possible to allow such collecting duct to be commonly used with any of varying outer diameters of exhaust pipes, that is, for any of varying engine displacements. In the practice of this embodiment, with the use of the adaptor pipe 28, the associated exhaust pipe 21 is expanded in diameter. Each of the exhaust pipes 21 and the associated adaptor pipe 28 are fixed together by means of welding and, similarly, each of the adaptor pipes 28 and the collecting duct 27 are fixed together by means of welding. It is to be noted that the exhaust pipes 21, the merging region 22 and the muffler 23 all referred to above form an exhaust system ES of the present invention.

Figure 2:
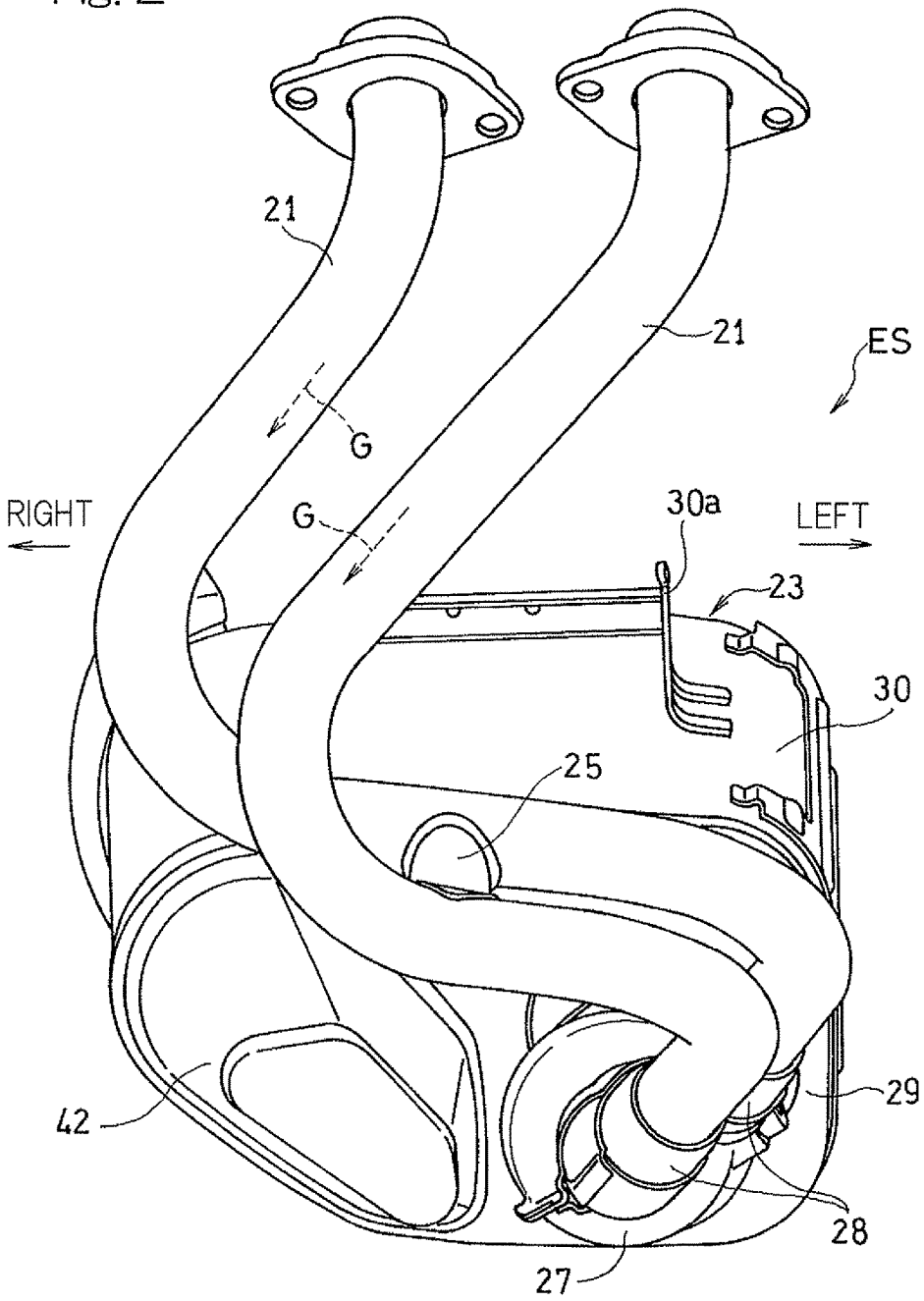
FIG. 2 is a schematic front elevational view showing the exhaust system.
Figure 3:
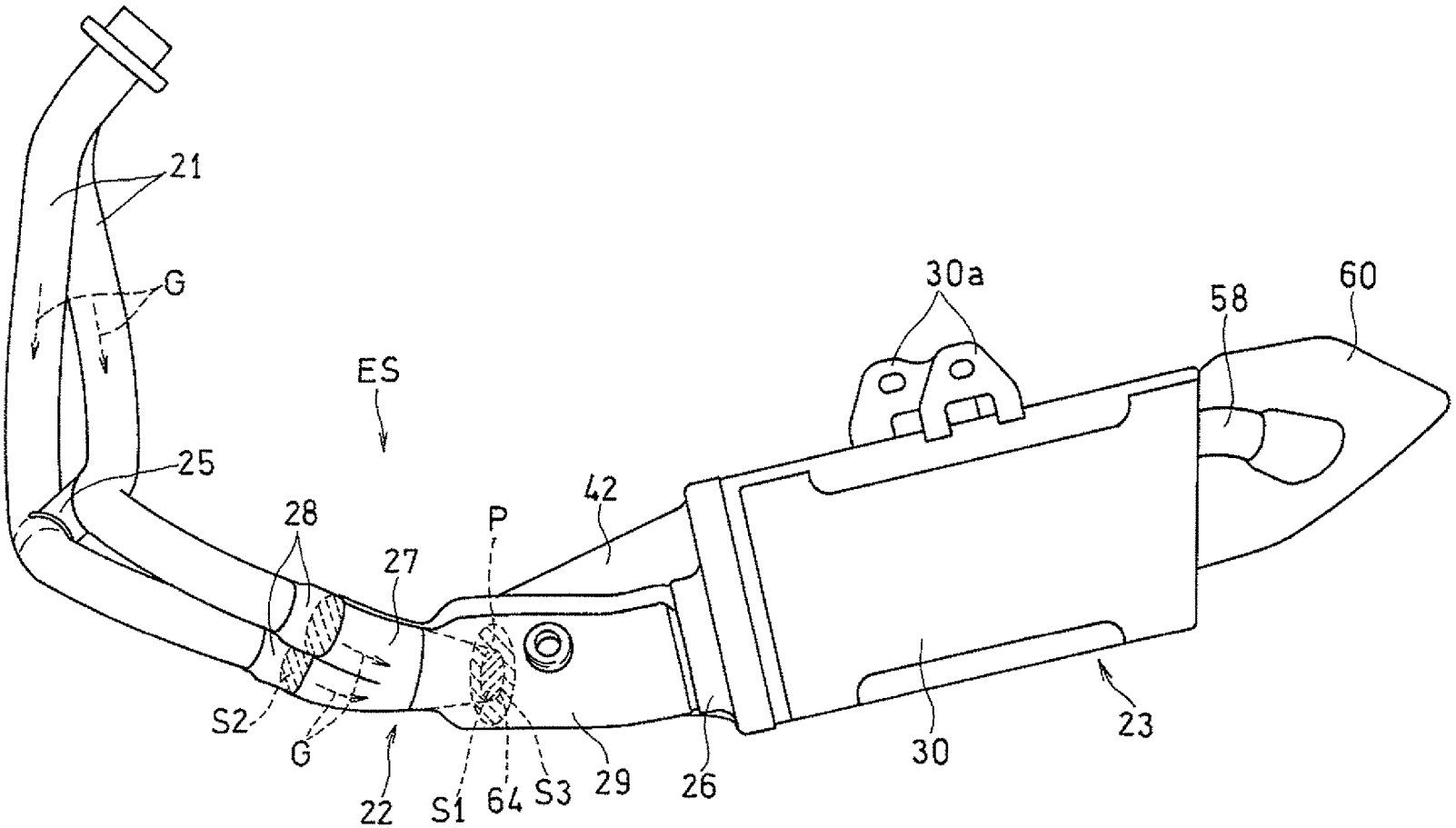
FIG. 3 is a schematic side view showing the exhaust system.

FIG. 2 is a schematic front elevational view showing the exhaust system ES for the engine E and FIG. 3 is a schematic side view thereof. As shown in FIG. 2, the exhaust pipes 21 are, after having extended from exhaust ports 20 (best shown in FIG. 1) downwardly, markedly curved leftwards and rightwards (in a motorcycle widthwise direction) before they are fluid connected with a front surface of the collecting duct 27 at the merging region 22. Those two exhaust pipes 21 and 21 are communicated with each other through a communicating pipe 25 at an intermediate portion thereof. The exhaust pipes 21 and adaptor pipes 28 are made of a stainless pipe. Each of the collecting duct 27 and the introducing pipe 29 is of a two piece construction defined by two longitudinally split or radially divided stainless pipe halves that are welded together.

As shown in FIG. 3, the muffler casing 30 has a mounting fixture 30*a* fixedly secured to an upper portion thereof by means of welding, and through this mounting fixture 30*a* the muffler casing 30 is fixed to a lower end of the main frame (best shown in FIG. 1) by means of a bolt (not shown).

Figure 4:
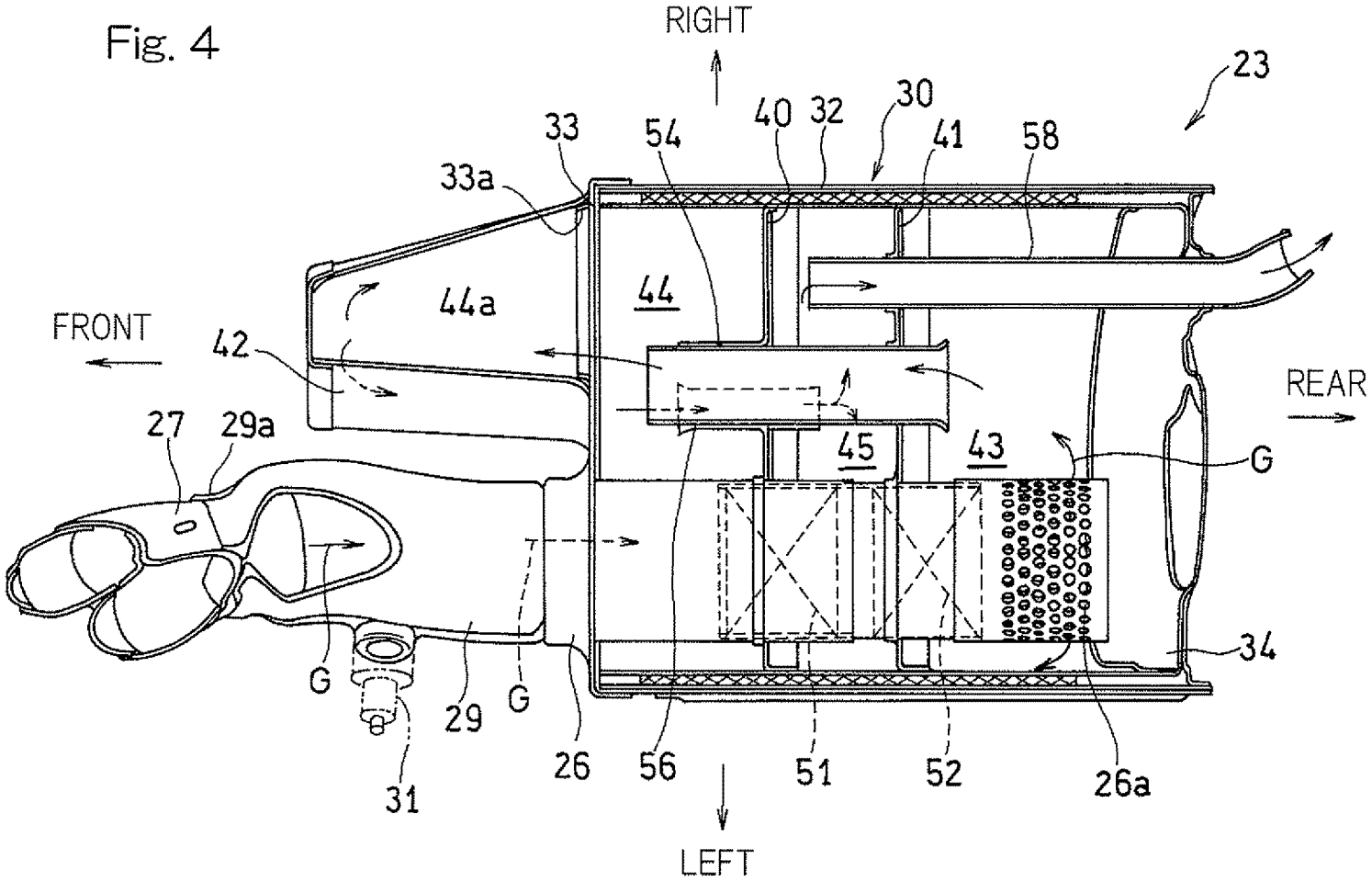
FIG. 4 is a schematic sectional view showing a muffler used in the exhaust system.

FIG. 4 is a horizontal sectional view showing the muffler 23 referred to above. The muffler casing 30 includes open-ended barrel portion 32, having front and rear ends opening, and front side and rear side end plates 33, 34 that close respective openings at the front and rear ends of the barrel portion 32. The barrel portion 32 and the end plates 33, 34 at the front and rear sides are integrated together by means of welding.

The interior of the muffler casing 30 is divided into first, second and third expansion chambers 43, 44 and 45 by two partition plates 40 and 41 that are secured to an inner peripheral surface of the barrel portion 32. The first and second expansion chambers 43 and 44 are communicated with each other via a first communicating pipe 54, and the second and third expansion chambers 44 and 45 are communicated with each other via a second communicating pipe 56. The first expansion chamber 43 on an upstream side is positioned at a rearmost portion of the muffler casing 30, and the second expansion chamber 44 on an downstream side of the first expansion chamber 43 is positioned at a frontmost portion of the muffler casing 30. The third expansion chamber 45 is disposed intermediate between the first and second expansion chambers 43 and 44. Also, a discharge pipe 58 communicating the third expansion chamber 45 with the outside is, in a condition with having passed through the partition wall 41 and the rear side end plate 34, supported by the partition plate 41 and the rear side end plate 34.

Also, the inlet pipe 26 is provided for introducing therethrough the exhaust gases G into an interior of the muffler casing 30 and is, in a condition with having been passed through the front side end plate 33 and the two partition plates 40 and 41, supported by the front side end plate 33 and the two partition plates 40 and 41. The inlet pipe 26 has its upstream end connected with a rear end of the introducing pipe 28. The inlet pipe 26 extends through a left side portion of the front side end plate 33. An opening 33*a* in the form of a throughhole is formed in a right side portion of the front side end plate 33, and a cup shaped expansion casing 42 is fluid connected with this opening 33*a*. The expansion casing 42 forms an expansion portion 44*a* of the second expansion chamber 44.

The inlet pipe 26 includes therein a first catalytic converter 51 on an upstream side and a second catalytic converter 52 on a downstream side. The inlet pipe 26 has a downstream end portion in which a plurality of punched holes 26*a* are formed.

Figure 5:
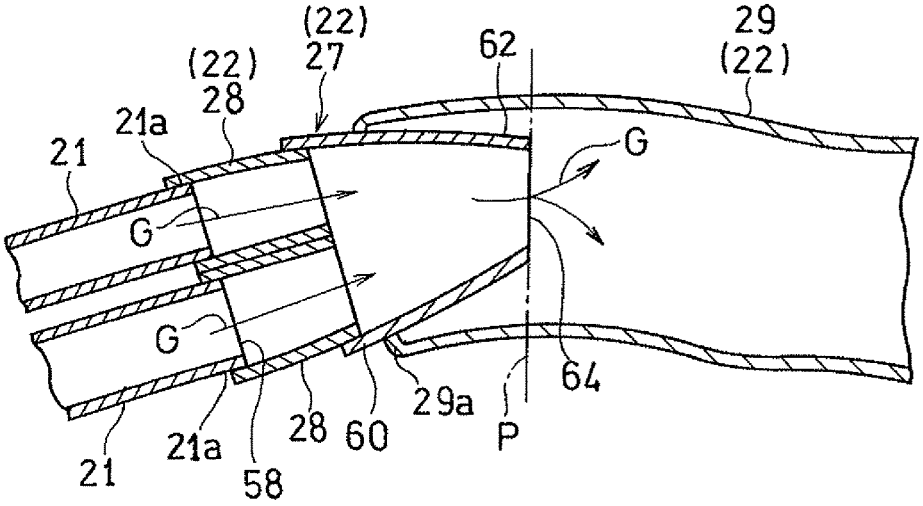
FIG. 5 is a schematic sectional view showing a joint in the exhaust system, which is formed between an introducing pipe and a collecting duct.

FIG. 5 illustrates a schematic sectional view showing a joint formed between the introducing pipe 29 and the collecting duct 27. The collecting duct 27 has a large diameter portion 60, in which the downstream end portion 21*a* forming a discharge opening 58 of each of the two exhaust pipes 21 is inserted through the adaptor pipe 28, and a reduced diameter portion 62 which is inserted into the interior of the introducing pipe 29. The collecting duct 27 has a passage area or a cross-sectional area that gradually decreases from the large diameter portion 60 towards the reduced diameter portion 62. At the large diameter portion 60, the collecting duct 27 is fixed to an upstream end portion 29*a* of the introducing pipe 29 by means of welding.

The collecting duct 27 has a single outlet opening 64 within the interior of the introducing pipe 29, and a first passage area S1 of the outlet opening 64 shown in FIG. 3 is chosen to be smaller than the sum S2 of the respective second passage areas of the discharge openings 58, 58 of the two exhaust pipes 21, 21 (that is, S1<S2), but also smaller than a third passage area S3 of the introducing pipe 29 at the position P of the outlet opening 64 (that is, S1<S3).

The first passage area S1 of the outlet opening 64 of the collecting duct 27 is so set to be smaller than the sum S2 of the respective second passage areas of the discharge openings 21*a* of the exhaust pipes 21, and thus, the exhaust passage for the exhaust gases G is constricted within the collecting pipe 27. For this purpose, the first passage area S1 is preferably within the range of 0.6 to 0.9 times the sum S2 of the second passage areas (S1=(0.6 to 0.9) S2) and, more preferably, within the range of 0.70 to 0.85 times the sum S2 of the second passage areas (S1=(0.70 to 0.85) S2). Also, the first passage area S1 is so set to be sufficiently smaller than the third passage area S3 of the introducing pipe 29 at the position P of the outlet opening 64. Thus, the exhaust gases G expand, when emerging outwardly from the outlet opening 64, and the pressure of the exhaust gases G may be lowered. Here, the first passage area S1 is preferably within the range of 0.2 to 0.5 times the third passage area S3 (S1=(0.2 to 0.5)S3) and, more preferably within the range of 0.3 to 0.4 times the third passage area S3 (S1=(0.3 to 0.4) S3).

If the first passage area S1 is smaller than 0.6 times the sum S2 of the second passage areas, the exhaust passage will be constricted too much and the pressure resistance will therefore increase. On the other hand, if the first passage area S1 exceeds 0.9 times the sum S2 of the second passage areas, an effect to suppress the exhaust interference will be lowered and, therefore, no sufficient exhaust efficiency can be obtained. Also, if the first passage area S1 is smaller than 0.2 times the third passage area S3, since the first passage area S1 of the outlet opening 64 of the collecting duct 27 cannot be reduced to a very small value, the inner diameter of the introducing pipe 29 will become increased and the introducing pipe 29 will therefore increase in size. On the other hand, if the first passage area S1 exceeds 0.5 times the third passage area S3, the pressure reduction will be small and therefore, no sufficient exhaust efficiency can be obtained.

When the engine shown in FIG. 1 is started, the exhaust gases G shown in FIG. 3 are discharged from the exhaust pipes 21, and are in turn merged together at the merging region 22. At the merging region 22 shown in FIG. 5, the exhaust gases G guided into the collecting duct 27, after having been somewhat expanded by the adaptor pipe 28, flow into the collecting duct 27. Then, the exhaust gases G are constricted at the reduced diameter portion 62 of the collecting duct 27, and are discharged into and are expanded within the introducing pipe 29.

The exhaust gases G so introduced into the introducing pipe 29 flow into the input pipe 26 of the muffler 23 shown in FIG. 4 and are thereafter guided into the first expansion chamber 43 through the first and second catalytic converters 51 and 52 by way of the input pipe 26. The exhaust gases G so introduced into the first expansion chamber 43 are thus expanded within this first expansion chamber 43.

Also, the exhaust gases G, when flowing from the first expansion chamber 43 towards the second expansion chamber 44 through the first communicating pipe 54 and also towards the third expansion chambers 45 through the second communicating pipe 56, undergo constriction and expansion repeatedly enough to consume energies, with the consequence that noises are sufficiently reduced. The exhaust gases G introduced into the third expansion chamber 45 are discharged to the outside of the muffler 23 through the discharge pipe 58.

In the construction described hereinabove, the flow velocity of the exhaust gases G is increased by constricting the first passage area S1 at the outlet opening 64 of the collecting duct 27 shown in FIG. 3. By so doing, the exhaust interference from the two exhaust pipes 21 can be suppressed. As discussed above, by alternately deriving the exhaust gases G, the exhaust efficiency can be increased. Also, after the first passage area S1 has been constricted, the third passage area S3 is abruptly increased within the interior of the introducing pipe 29 to induce a pressure drop. Thus, a force of pulling the exhaust gases G from the exhaust pipes 21 become large, and the exhaust efficiency can be further effectively increased. In addition, since no component is added, there is no need to consider the space for installation, and the space around the engine will not be oppressed.

Figure 6:
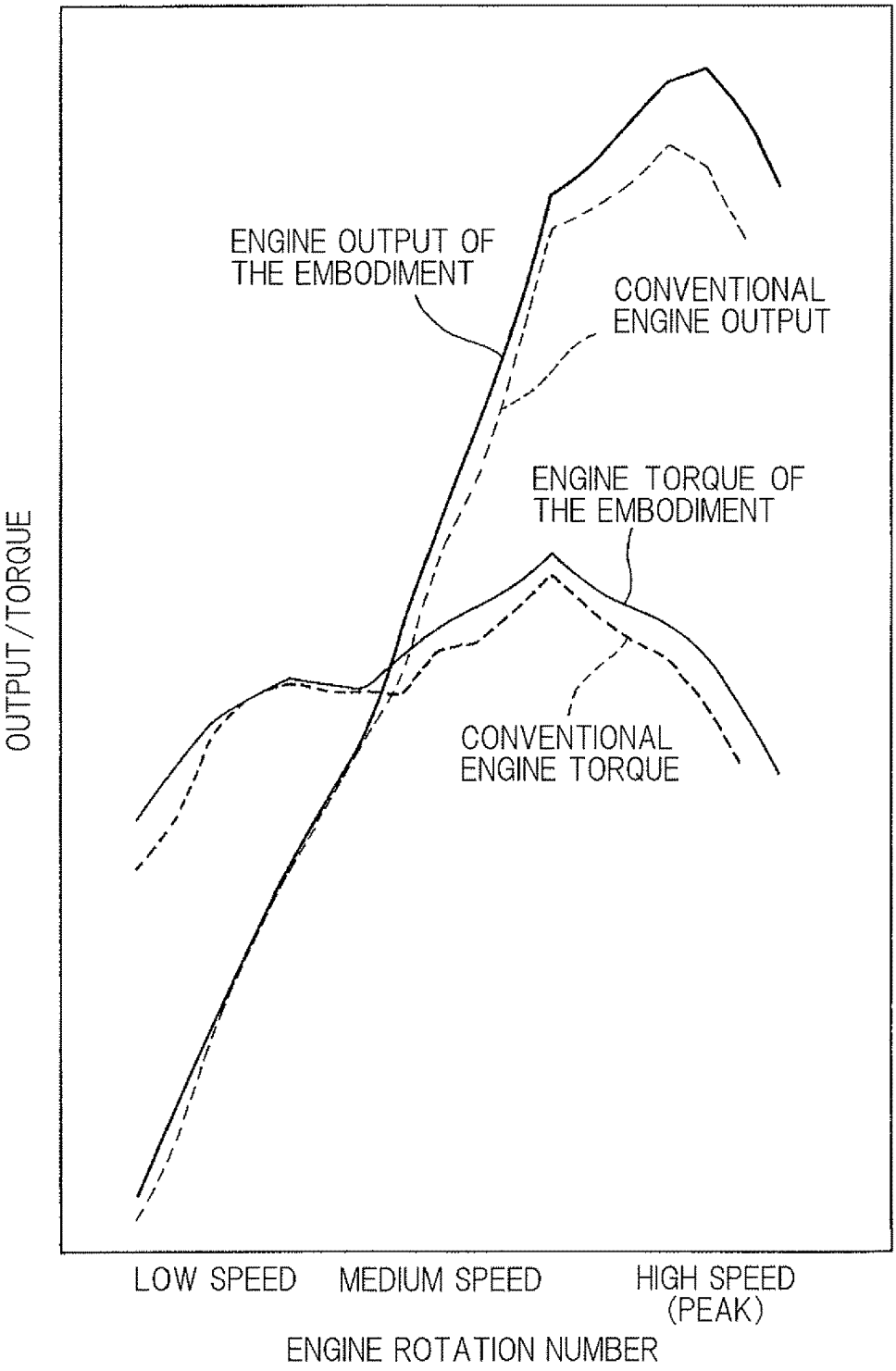
FIG. 6 is a chart showing an output/torque relative to an engine rotational number of the engine utilizing the exhaust system and a conventional engine.

FIG. 6 illustrates a chart showing values of an output/torque relative to an engine rotation number of the engine utilizing the exhaust system of the present embodiment and the conventional engine. Those values have been obtained by means of simulation tests. As the chart of FIG. 6 makes it clear, in the conventional engine, the output and the torque were lowered during a low speed rotation range and a medium speed rotation, accompanied by dales appearing in the chart. In contrast thereto, in the engine utilizing the exhaust system ES designed in accordance with the preferred embodiment, those dales are removed, and also the output at a peak is increased.

As shown in FIG. 5, the collecting duct 27 has its passage area gradually decreasing from the large diameter portion 60 to the small reducing portion 62, and the large diameter portion 60 is fluid connected with the exhaust pipes 21. Accordingly, the exhaust gases G from the exhaust pipe 21 flow smoothly within the interior of the collecting duct 27 from the large diameter portion 60 towards the small diameter portion 62. In addition, the introducing pipe 29 is fixed to the large diameter portion 60 of the collecting duct 27, and therefore, it is possible to firmly connect the introducing pipe 29 and the collecting duct 27 together.

Also, the downstream end portion 21*a* of each of the exhaust pipes 21 is fluid connected with the collecting duct 27 through the adapter pipe 28. Therefore, the collecting duct 27 and the introducing pipe 29, both forming the merging region 22, can be commonly used with exhaust pipes having varying outer diameters. Accordingly, the muffler 23 can also be commonly used. In particularly, since the muffler 23 can be commonly used, an effect that the cost can be reduced is markedly appreciated.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. By way of example, the present invention can be equally applied to a four cylinder engine. In this case, on a downstream side of a first upstream merging region where four exhaust pipes are merged into two pipes, a second downstream merging region, where the merged two pipes is merged into a single pipe, is provided and the present invention is applied to the second downstream merging region.

Also, although in describing the preferred embodiment as set forth hereinabove reference has been made to the engine mounted on the motorcycle, the present invention can be equally applied to any vehicle other than the motorcycle, a marine engine and, yet, a ground installed engine.

Accordingly, such changes and modifications are, unless they depart from the scope of the present invention as delivered from the claims annexed hereto, to be construed as included therein.

REFERENCE NUMERALS

21 . . . Exhaust pipe
21*a* . . . Discharge opening (Downstream end portion of exhaust pipe)
23 . . . Muffler
27 . . . Collecting duct
28 . . . Adaptor pipe
29 . . . Introducing pipe
58 . . . Discharge opening
60 . . . Large diameter portion of the collecting duct
62 . . . Small diameter portion of the collecting duct
64 . . . Outlet opening of the collecting duct
E . . . Engine
ES . . . Exhaust system
G . . . Exhaust gases
S1 . . . First surface area of the outlet opening of the collecting duct
S2 . . . Passage area of the discharge opening of the exhaust pipe
S3 . . . Third passage area of the introducing pipe at a position corresponding to the outlet opening

What is claimed is:

1. An exhaust system for an engine comprising:

two exhaust pipes to discharge therethrough exhaust gases from the engine;

a muffler to silence the exhaust gases;

an introducing pipe to introduce the exhaust gases into the muffler; and a collecting duct to merge the exhaust gases from the two exhaust pipes and then to introduce the exhaust gases into the introducing pipe; wherein the exhaust pipes are connected with the collecting duct, the collecting duct is connected with the introducing pipe, and the introducing pipe is connected with the muffler, the exhaust gases discharged from each of the exhaust pipes are mixed within the collecting duct, the exhaust gases so mixed are introduced to the introducing pipe, and the exhaust gases having passed through the introducing pipe are introduced to the muffler, the collecting duct has a single outlet opening defined in an interior of the introducing pipe, the single outlet opening has a first passage area that is chosen to be smaller than the sum of respective second passage areas of discharge openings of the two exhaust pipes and also to be smaller than a third passage area of a portion of the introducing pipe, which portion corresponds to the outlet opening, the collecting duct has a passage area which gradually decreases from a large diameter portion, in which the discharge openings of the two exhaust pipes are inserted, towards a small diameter portion which is inserted into an interior of the introducing pipe, and the large diameter portion is fluid connected with the introducing pipe.

2. The exhaust system for the engine as claimed in claim 1, wherein a downstream end portion of the exhaust pipe, which forms the discharge opening, is fluid connected with the collecting duct through an adaptor pipe mounted thereon.

3. The exhaust system for the engine as claimed in claim 1, wherein the first passage area of the outlet opening of the collecting duct is 0.6 to 0.9 times the sum of the second passage areas of the discharge openings of the two exhaust pipes.

4. The exhaust system for the engine as claimed in claim 1, wherein the first passage area of the outlet opening of the collecting duct is 0.2 to 0.5 times the third passage area of the introducing pipe at a position of such outlet opening.

5. The exhaust system for the engine as claimed in claim 2, wherein the adaptor pipe is provided for each of the exhaust pipes.

6. The exhaust system for the engine claimed in claim 1 wherein the introducing pipe includes an exhaust component detecting sensor for detecting the content of oxygen contained in the exhaust gases.

7. An exhaust system for a motorcycle engine comprising:

a collecting duct and adapter pipes for connecting to exhaust pipes extending from the motorcycle engine for conveying exhaust gases from the motorcycle engine;

an introducing pipe for transporting the exhaust gases from the collecting duct to catalytic converters within a muffler casing; and a plurality of expansion chambers within the muffler casing for receiving the exhaust gases from the catalytic converter to reduce noise with one expansion chamber adjacent a front most portion of the muffler casing is connected to an expansion portion extending outward from the foremost muffler casing and positioned above and separate from the introducing pipe in the form of a cup shaped expansion chamber.

* * * * *